US008550838B2

(12) United States Patent
Osagle et al.

(10) Patent No.: US 8,550,838 B2
(45) Date of Patent: Oct. 8, 2013

(54) ELECTRICAL CONNECTOR HAVING POKE-IN WIRE CONTACT

(75) Inventors: Osenaga Jerry Osagle, Harrisburg, PA (US); Matthew Edward Mostoller, Hummelstown, PA (US); Ricky Edward Brown, Lykens, PA (US); Ronald Martin Weber, Annville, PA (US); Christopher G. Daily, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 52 days.

(21) Appl. No.: 13/190,025

(22) Filed: Jul. 25, 2011

(65) Prior Publication Data

US 2013/0029529 A1 Jan. 31, 2013

(51) Int. Cl.
*H01R 11/20* (2006.01)

(52) U.S. Cl.
USPC ..... 439/441; 439/835

(58) Field of Classification Search
USPC ..... 439/268, 441, 835
See application file for complete search history.

(56) References Cited

U.S. PATENT DOCUMENTS

| | | | | |
|---|---|---|---|---|
| 3,796,987 | A * | 3/1974 | Kinkaid et al. | 439/748 |
| 5,324,213 | A | 6/1994 | Frantz | |
| 5,453,023 | A * | 9/1995 | Capper et al. | 439/410 |
| 5,525,070 | A * | 6/1996 | Axelsson | 439/268 |
| 6,244,904 | B1 | 6/2001 | Fabian et al. | |
| 6,682,364 | B2 * | 1/2004 | Cisey | 439/441 |
| 7,204,727 | B2 * | 4/2007 | Germani | 439/835 |
| 7,485,015 | B2 * | 2/2009 | Coffy | 439/828 |
| 7,628,640 | B2 * | 12/2009 | Radle | 439/441 |
| 8,328,586 | B2 * | 12/2012 | Bies et al. | 439/725 |
| 2011/0250775 | A1 | 10/2011 | Bies et al. | |
| 2011/0250803 | A1 | 10/2011 | Bies | |

FOREIGN PATENT DOCUMENTS

| | | | |
|---|---|---|---|
| DE | 19735835 | A1 | 2/1999 |
| DE | 20 2006 000380 | U1 | 2/2007 |
| DE | 10 2005 048972 | A1 | 4/2007 |
| DE | 10 2008 039232 | A1 | 2/2010 |
| EP | 0 675 568 | A1 | 10/1995 |
| WO | 2010 146525 | A1 | 12/2010 |

OTHER PUBLICATIONS

International Search Report, International Application No. PCT/US2012/047271, International Filing Date Jul. 19, 2012.
International Search Report, International Application No. PCT/US2013/039235, International Filing Date Feb. 5, 2013.

* cited by examiner

*Primary Examiner* — Thanh Tam Le

(57) ABSTRACT

An electrical connector is provided including a housing having a receptacle for receiving a wire. A fixed contact is positioned within the housing and has a termination contact configured to electrically couple to a signal path. A moveable contact is electrically coupled to the fixed contact. The moveable contact has a contact interface for engaging the wire. The contact interface is moveable between a connection position, wherein the contact interface engages the wire, and a release position, wherein the contact interface is disengaged from the wire to enable the wire to be removed from the receptacle.

19 Claims, 12 Drawing Sheets

ELECTRICAL CONNECTOR HAVING POKE-IN WIRE CONTACT

BACKGROUND OF THE INVENTION

The subject matter described herein relates generally to an electrical connector having a poke-in wire contact.

Substrate assemblies generally include a substrate having electrical components that are electrically coupled through signal paths, for example, signal traces and/or wires. Often, the substrate assembly is required to be electrically coupled to wires from other substrate assemblies and/or electrical components that are part of the substrate assembly. The substrate may include an electrical connector positioned thereon to receive the wires from the other substrate assemblies and/or electrical components. The electrical connector includes a contact that is surface mounted or through-hole mounted to the substrate to provide an electrical connection between the signal path of the substrate and the electrical connector. A mating end of the contact is configured to engage the wire of the other substrate assembly and/or electrical component. The mating end of the contact engages the wire to provide an electrical connection between the other substrate assembly and/or electrical component and the signal path of the substrate. The electrical connection enables power and/or data signals to be transmitted between the other substrate assembly and/or electrical component and the substrate assembly.

Some substrate assemblies utilize a connector having a poke-in wire contact. The connector includes a housing having a receptacle that receives the wire. A contact interface extends into the receptacle. As the wire is positioned in the receptacle, the wire engages the contact interface. Generally, the contact interface is angled so that the contact interface engages the wire, when a force is applied to the wire in a direction opposite of insertion. Accordingly, the contact interface prevents the wire from being pulled out of the receptacle.

However, conventional poke-in wire contacts are not without their disadvantages. In particular, because the contact interface engages the wire, the wire cannot be removed from the receptacle without causing significant damage to the wire and/or contact that may require the wire and/or contact to be replaced. However, the wire may be required to be removed from the receptacle to facilitate product testing and/or repair.

A need remains for a poke-in wire contact that enables the contact interface to be disengaged from the wire. Another need remains for a poke-in wire contact that enables the wire to be inserted into and removed from the receptacle multiple times without damaging the wire.

SUMMARY OF THE INVENTION

In one embodiment, an electrical connector is provided including a housing having a receptacle for receiving a wire. A fixed contact is positioned within the housing and has a termination contact configured to electrically couple to a signal path. A moveable contact is electrically coupled to the fixed contact. The moveable contact has a contact interface for engaging the wire. The contact interface is moveable between a connection position, wherein the contact interface engages the wire, and a release position, wherein the contact interface is disengaged from the wire to enable the wire to be removed from the receptacle.

In another embodiment, a substrate assembly is provided including a substrate having a signal path extending therethrough. A connector is positioned on the substrate. The connector includes a housing having a receptacle for receiving a wire. A fixed contact is positioned within the housing and has a termination contact at least one of surface mounted or through-hole mounted to the substrate. The fixed contact is electrically coupled to the signal path. A moveable contact is electrically coupled to the fixed contact. The moveable contact has a contact interface for engaging the wire. The contact interface is moveable between a connection position, wherein the contact interface engages the wire, and a release position, wherein the contact interface is disengaged from the wire to enable the wire to be removed from the receptacle.

BRIEF DESCRIPTION OF THE DRAWINGS

The presently disclosed subject matter will be better understood from reading the following description of non-limiting embodiments, with reference to the attached drawings, wherein below.

DETAILED DESCRIPTION OF THE DRAWINGS

Figure 1:
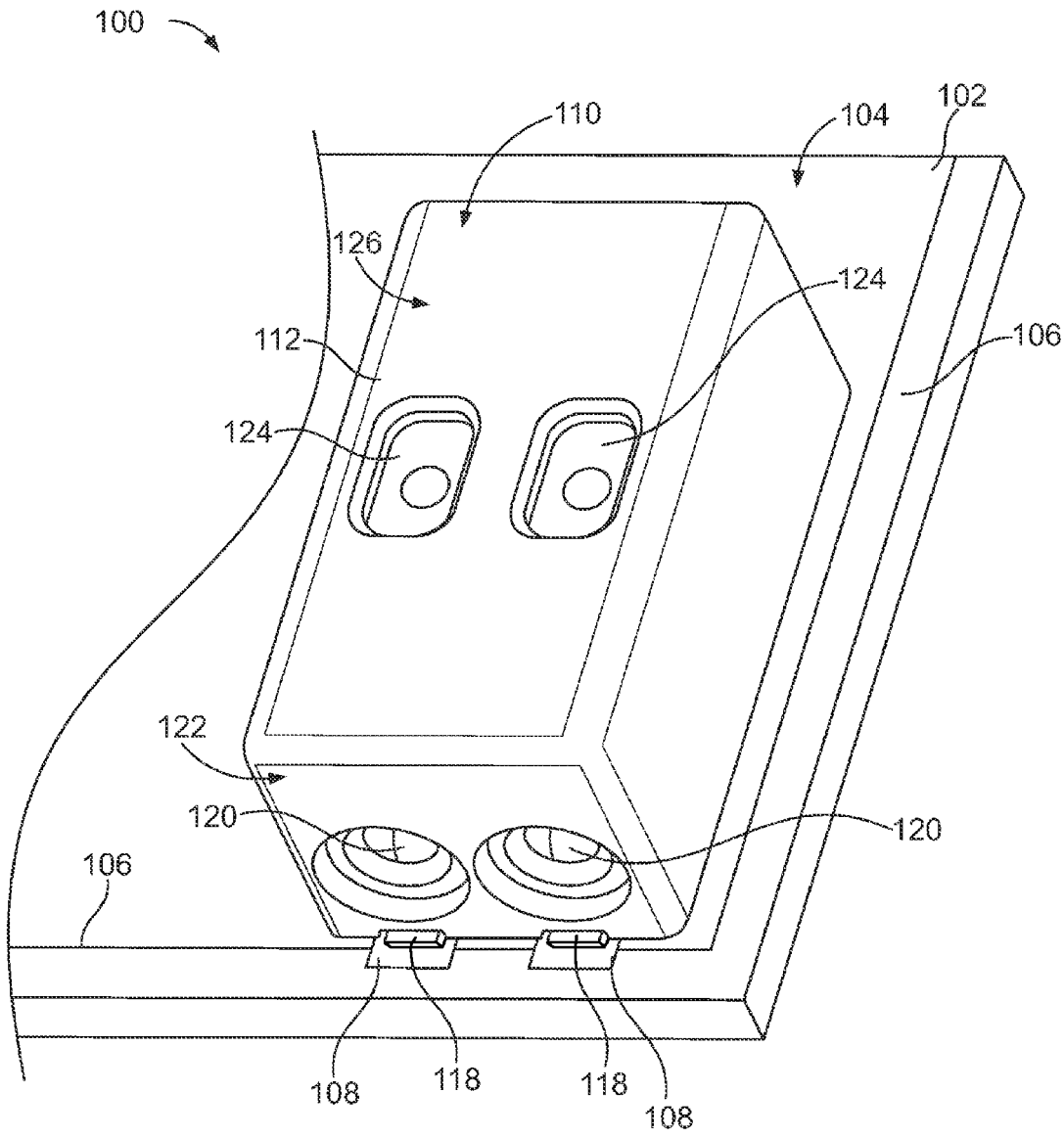
FIG. 1 is a top perspective view of a substrate assembly formed in accordance with an embodiment.

The foregoing summary, as well as the following detailed description of certain embodiments will be better understood when read in conjunction with the appended drawings. As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Various embodiments provide a connector that enables a wire to be removed therefrom without causing significant damage to the wire and/or a contact of the connector. The connector includes a moveable contact that disengage the wire so that the wire may be removed without damage. The various embodiments provide a connector that enables the wire to be removed without having to replace or repair the wire and/or a contact of the connector. The various embodiments provide a connector that enables a wire to be inserted therein and removed therefrom multiple times to allow for testing and/or repair of the connector.

Exemplary embodiments described herein include an electrical connector having a housing. A receptacle is formed in the housing to receive a wire. A fixed contact is positioned within the housing. The fixed contact includes an opening that is aligned with the receptacle of the housing. The opening receives the wire therethrough. In one embodiment, the opening may be sized to receive different gauge wires. The fixed contact includes a termination contact that is configured to electrically couple to a signal path. For example, the termination contact of the fixed contact may surface mount or through-hole mount to a substrate having the signal path extending therethrough to create an electrical connection with the signal path.

In exemplary embodiments, a moveable contact is configured to be electrically coupled to the fixed contact. The moveable contact has a contact interface that engages the wire. The contact interface is moveable between a connection position and a release position. In the connection position, the contact interface engages the wire. In one embodiment, the contact interface includes a pair of tabs. The wire is secured between the tabs when the contact interface is in the connection position. In another embodiment, the contact interface compresses the wire in the connection position. In the release position, the contact interface is disengaged from the wire to enable the wire to be removed from the receptacle. In one embodiment, an actuator engages the moveable contact to move the contact interface between the connection position and the release position. The moveable contact may be a spring loaded contact. Optionally, the moveable contact may be a spring contact. Alternatively, the moveable contact may be rotatable about a pivot point to move the contact interface between the connection position and the release position. In one embodiment, the moveable contact may be biased into the connection position.

FIG. 1 is a top perspective view of a substrate assembly 100 formed in accordance with an embodiment. The substrate assembly 100 includes a substrate 102 having a substrate surface 104. The substrate 102 may be a circuit board, for example, a printed circuit board. The substrate 102 may be part of an electronic device. In one embodiment, the substrate 102 may be a mother board, a daughter card, a back plane circuit board, a mid plane circuit board, or the like. The substrate 102 may be configured to have a plurality of electrical components coupled thereto, for example, surface mounted or through-hole mounted to the substrate surface 104. The substrate 102 includes a signal path 106 extending therethrough. The signal path 106 may be a signal trace, a wire, or any other suitable electrical signal path. The signal path 106 may be configured for transmitting power and/or data signals between the various electrical components coupled to the substrate 102. The signal path 106 may be embedded within the substrate 102 or extend along the substrate surface 104. Signal vias 108 are provided on the substrate surface 104. The signal vias 108 are configured to be electrically coupled to a contact of an electrical component to create an electrical connection between the electrical component and the signal path. Alternatively, the substrate 102 may include vias through which contacts of the electrical component are through-hole mounted to create an electrical connection between the electrical component and the signal path.

It should be noted, that although the various embodiments described herein are described with respect to being mounted on a substrate, the various embodiments may be utilized in a cable connector, wherein the signal path extends through the cable.

An electrical connector 110 is provided on the substrate 102. The electrical connector 110 is positioned on the substrate surface 104. The electrical connector 110 includes a housing 112 that encloses a pair of contact assemblies 114 (shown in FIG. 2). In one embodiment, the housing 112 may enclose any number of contact assemblies 114. Each contact assembly 114 includes a fixed contact 116 having through-hole mount tails 118 (both shown in FIG. 2). A through-hole mount tail 118 of each contact assembly 114 is illustrated in FIG. 1 as extending from the housing 112. The through-hole mount tails 118 are through-hole mounted through the signal vias 108 to create an electrical connection between the electrical connector 110 and the substrate 102. Alternatively, the through-hole mount tails 118 may be configured as surface-mount tails that are surface mounted to a signal pad of the substrate 102 to create an electrical connection between the electrical connector 110 and the substrate 102.

Receptacles 120 are formed in a front face 122 of the housing 112. Each receptacle 120 is aligned with a contact assembly 114 within the housing 112. Accordingly, the number of receptacles 120 formed in the housing 112 is equivalent to the number of contact assemblies 114 positioned within the housing 112. The receptacles 120 are configured to receive a wire 134 (shown in FIGS. 3 and 4) therethrough. For example, the wire 134 may be part of another electronic device and/or electrical component. The receptacles 120 receive the wire 134 to create an electrical connection between the wire 134 and the electrical connector 110. As such, an electrical connection is formed between the wire 134 and the signal paths 106.

Openings 123 are positioned in the top 126 of the housing 112. An actuator 124 formed on a moveable contact 128 (shown in FIG. 2) of each contact assembly 114 is accessible through an opening 123. The number of actuators 124 positioned in the housing 112 is equivalent to the number of contact assemblies 114 positioned within the housing 112. Accordingly, the number of openings 123 formed in the housing 112 is equivalent to the number of contact assemblies 114 positioned within the housing 112. By applying a force to the actuator 124 the moveable contact 128 is moved from a connection position 130 (shown in FIG. 3) to a release position 132 (shown in FIG. 4). In the release position 132, the wire 134 may be removed from the receptacle 120 and from the electrical connector 110.

Figure 2:
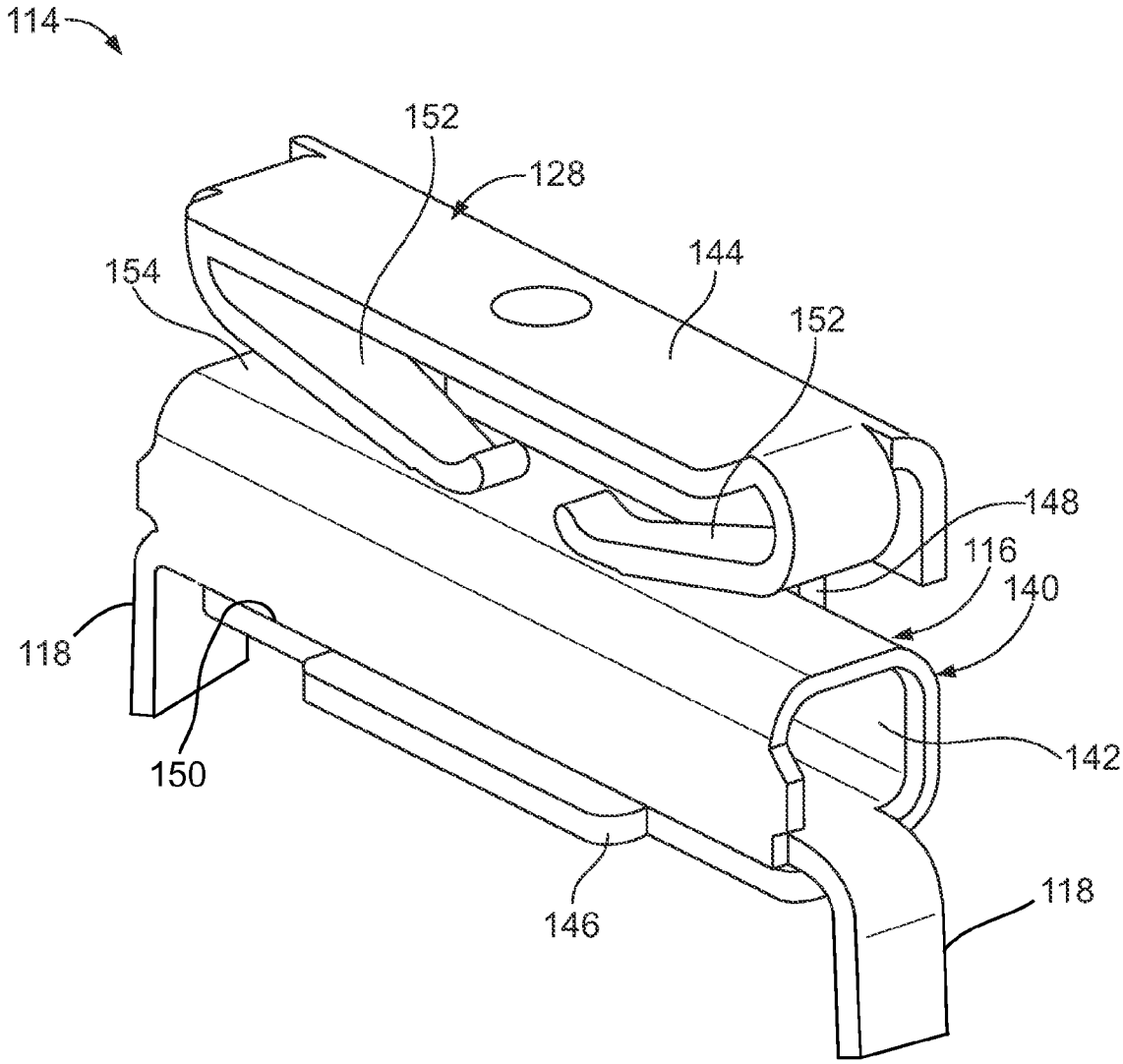
FIG. 2 is a top perspective view of a contact assembly formed in accordance with an embodiment and that may be used with the electrical connector shown in FIG. 1.

FIG. 2 is a top perspective view of a contact assembly 114 formed in accordance with an embodiment. As noted above, the electrical connector 110 (shown in FIG. 1) may include any number of contact assemblies 114. The contact assembly 114 is configured as a poke-in wire contact. The contact assembly 114 includes the fixed contact 116 and the moveable contact 128. The fixed contact 116 includes a barrel 140 having an opening 142 extending therethrough. The opening 142 aligns with the receptacle 120 of the connector housing 112 (both shown in FIG. 1) when the contact assembly 114 is positioned in the housing 112. The opening 142 receives the wire 134 (shown in FIGS. 3 and 4), when the wire 134 is inserted into the receptacle 120 of the housing 112. The through-hole mount tails 118 extend from the barrel 140.

Figure 3:
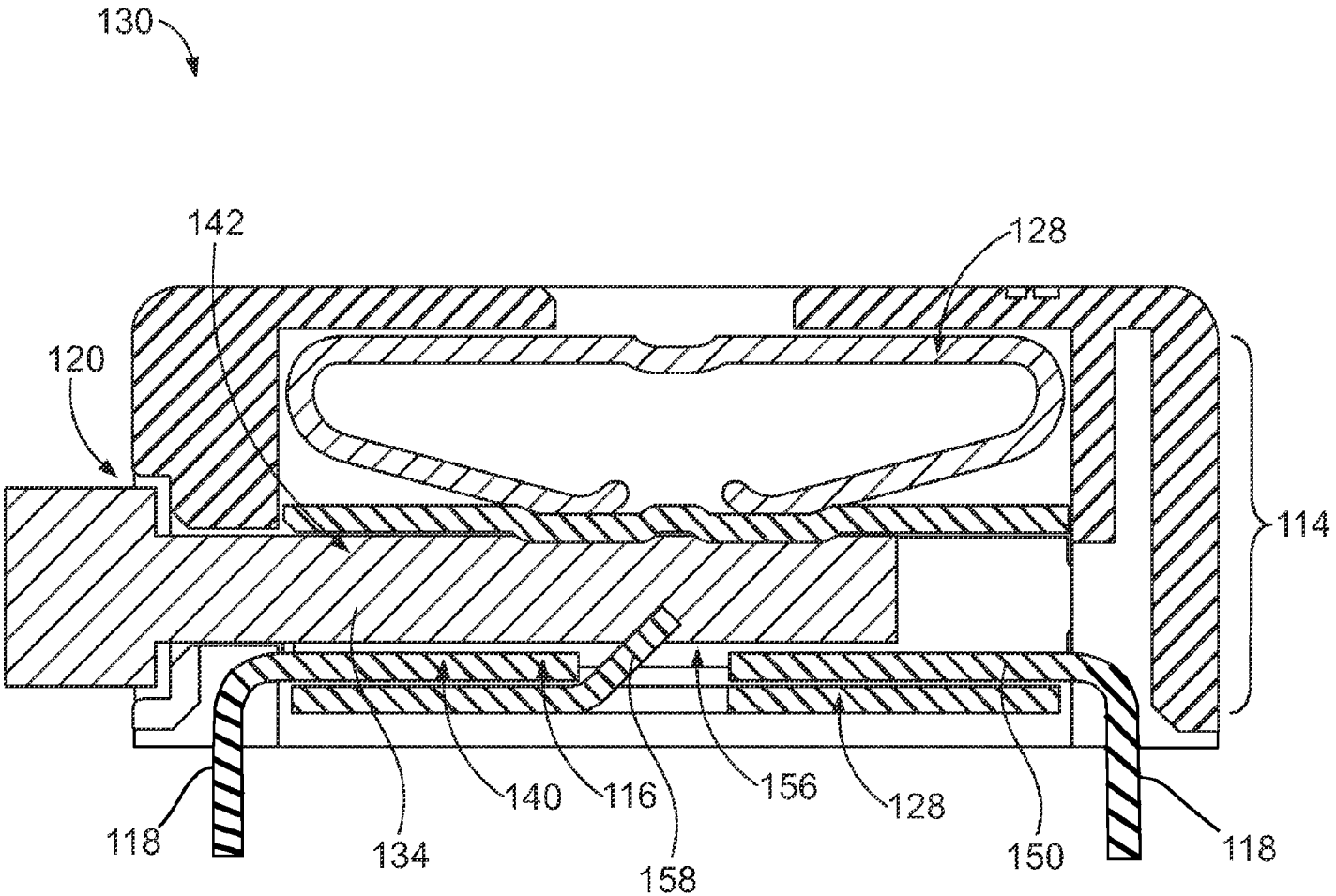
FIG. 3 is a side cross-sectional view of the electrical connector shown in FIG. 1 and having the moveable contact in a connection position.

The moveable contact 128 includes a top 144 and a bottom 146 that are integrally formed. The top 144 and the bottom 146 are joined by an intermediate portion 148. The fixed contact 116 is positioned between the top 144 and the bottom 146 of the moveable contact 128. The bottom 146 of the moveable contact 128 is positioned against a bottom 150 of the fixed contact 116, when the moveable contact 128 is in the connection position 130, as shown in FIG. 3. The top 144 of the moveable contact 128 includes a pair of springs 152. The springs 152 engage a top 154 of the fixed contact 116. The springs 152 bias the moveable contact 128 into the connection position 130. The actuator 124 is formed in the top 144 of the moveable contact 128.

FIG. 3 is a side cross-sectional view of the electrical connector 110 shown in FIG. 1. FIG. 3 illustrates the contact assembly 114 (shown in FIG. 2) positioned within the housing 112 (shown in FIG. 1). FIG. 3 illustrates the moveable contact 128 in the connection position 130. The wire 134 is inserted into the receptacle 120 of the housing 112. The wire 134 extends through the opening 142 in the barrel 140 of the fixed contact 116.

The bottom 150 of the fixed contact 116 includes an opening 156 extending therethrough. The bottom 146 of the moveable contact 128 includes a contact interface 158. In the connection position 130, the contact interface 158 extends through the opening 156 in the fixed contact 116. The contact interface 158 engages the wire 134. In an exemplary embodiment, the contact interface 158 compresses the wire 134. The contact interface 158 creates an electrical connection between the moveable contact 128 and the wire 134. The moveable contact 128 is electrically connected to the fixed contact 116 so that the contact interface 158 creates an electrical connection between the wire 134 and the contact assembly 114. The contact assembly 114 creates a further electrical connection with the substrate 102 (shown in FIG. 1) through the through-hole mount tails 118, when the connector 110 (shown in FIG. 1) is coupled to the substrate 102.

Figure 4:
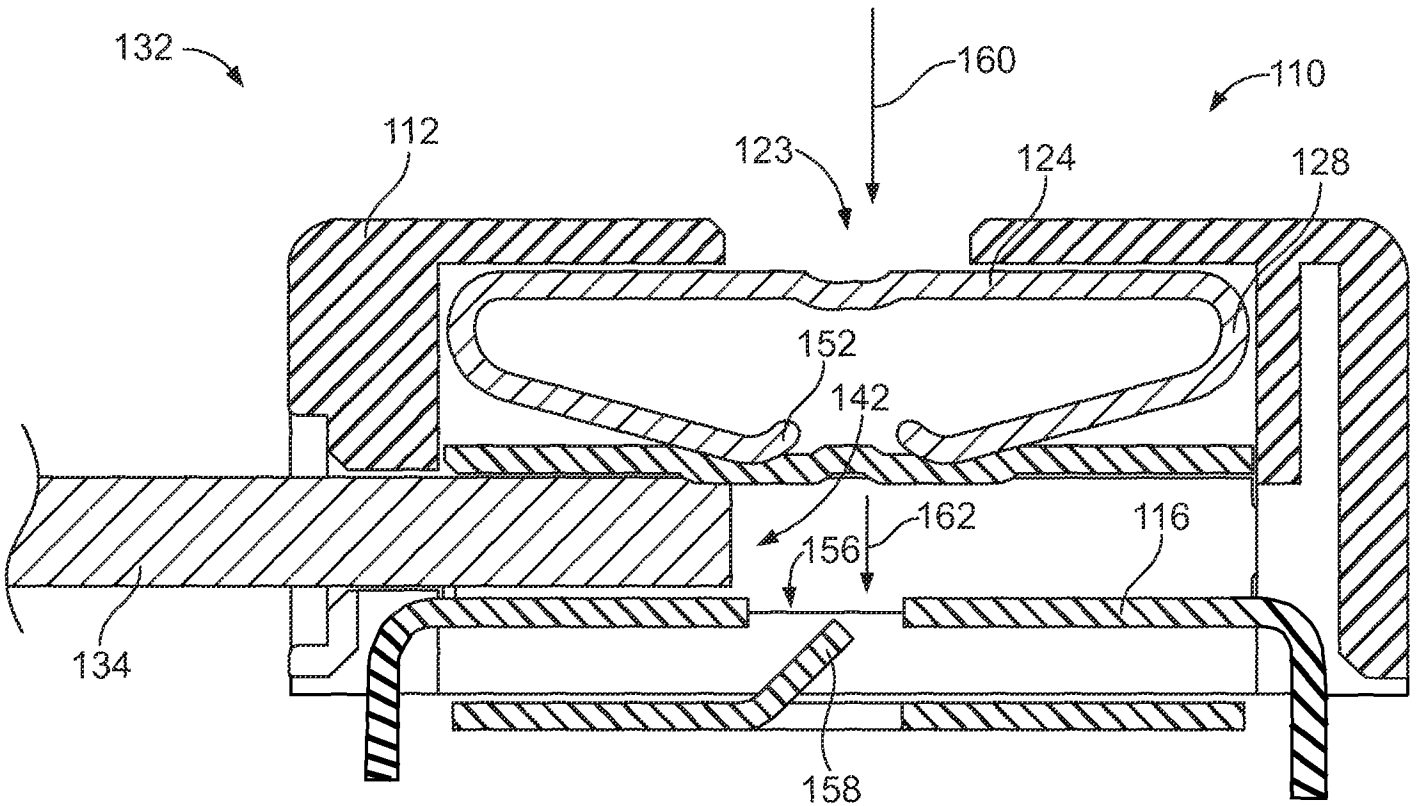
FIG. 4 is a side cross-sectional view of the electrical connector shown in FIG. 1 and having the moveable contact in a release position.

FIG. 4 is a side cross-sectional view of the electrical connector 110 having the moveable contact 128 in the release position 132. FIG. 4 illustrates the moveable contact 128 while receiving a force 160 on the actuator 124 through the opening 123 of the housing 112. The springs 152 of the moveable contact 128 are compressed so that the moveable contact 128 is moved in the direction of arrow 162. In the release position 132, the contact interface 158 no longer extends through the opening 156 in the fixed contact 116. Accordingly, the contact interface 158 is disengaged from the wire 134 so that the wire 134 is capable of being removed from the opening 142 of the fixed contact 116 and from the connector 110.

Figure 5:
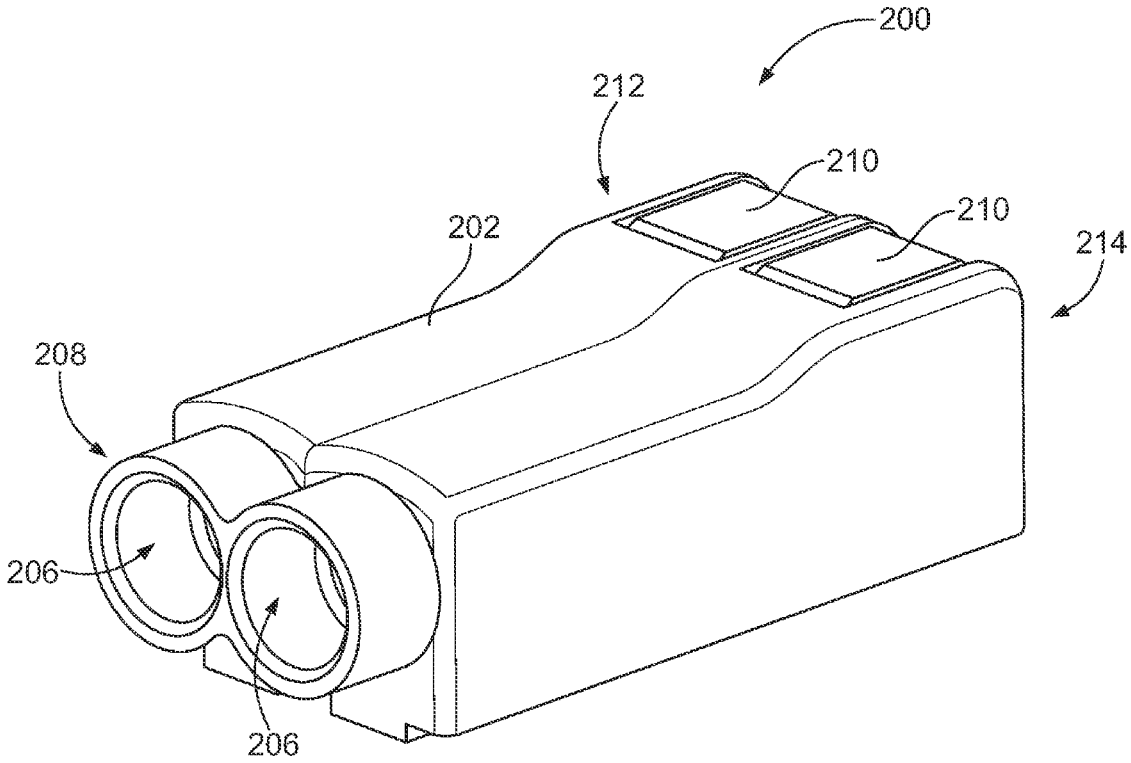
FIG. 5 is a top perspective view of an electrical connector formed in accordance with another embodiment.

FIG. 5 is a top perspective view of another electrical connector 200 formed in accordance with another embodiment. The electrical connector 200 is configured to be positioned on a substrate, for example, the substrate 102 shown in FIG. 1. In the illustrated embodiment, the electrical connector 200 is configured to be surface mounted to the substrate 102. Alternatively, the electrical connector 200 may be configured to be through-hole mounted to the substrate 102.

The electrical connector 200 includes a housing 202. The housing 202 encloses contact assemblies 204 (shown in FIG. 6). Receptacles 206 are formed in a front 208 of the housing 202. The receptacles 206 are each aligned with a contact assembly 204 positioned within the housing 202. The number of receptacles 206 is equivalent to the number of contact assemblies 204 positioned within the housing 202. The housing 202 may be configured with any number of contact assemblies 204 and corresponding receptacles 206. Each receptacle 206 is configured to receive a wire (not shown).

Actuators 210 are positioned on a top 212 of the housing 202. The actuators 210 are positioned at a back 214 of the housing 202. The actuators 210 are configured to engage the contact assembly 204 to move a moveable contact 216 (shown in FIG. 6) of the contact assembly 204 between a connection position 218 (shown in FIG. 8) and a release position 220 (shown in FIG. 9). The number of actuators 210 positioned within the housing 202 is equivalent to the number of contact assemblies 204 positioned within the housing 202.

Figure 6:
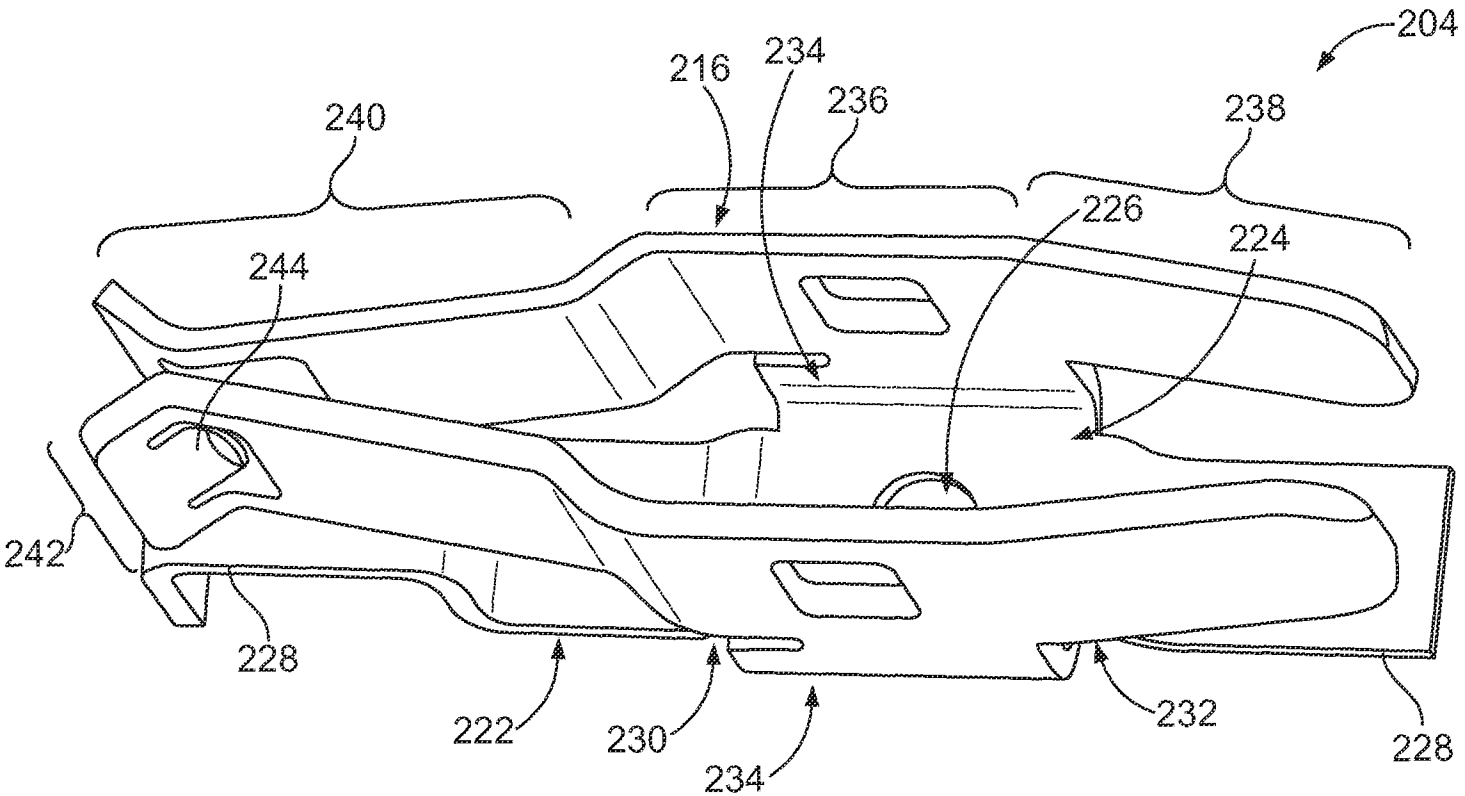
FIG. 6 is a top perspective view of a contact formed in accordance with an embodiment and that may be used with the electrical connector shown in FIG. 5.

FIG. 6 is a top perspective view of a contact assembly 204 formed in accordance with an embodiment. The contact assembly 204 includes a fixed contact 222 having a base 224. The fixed contact 222 is integrally formed with a pair of moveable contacts 216 to form the contact assembly 204. The base 224 includes an opening 226 extending therethrough to stake mount the contact assembly 204 to the housing 202 (shown in FIG. 5). Surface-mount tails 228 extend from a front 230 and a back 232 of the base 224. The surface-mount tails 228 are configured to be surface mounted to the substrate 102 (shown in FIG. 1). Optionally, the surface-mount tails 228 may be configured to be through-hole mounted to the substrate 102.

Each moveable contact 216 extends upward from a respective side 234 of the base 224 of the fixed contact 222. Each moveable contact 216 includes a pivot portion 236. The pivot portion 236 is joined to the base 224 of the fixed contact 222. An actuating end 238 of each moveable contact 216 extends from the pivot portion 236. The actuating end 238 extends rearward from the pivot portion 236. The actuating ends 238 of each moveable contact 216 are configured to be engaged by the actuator 210 (shown in FIG. 5), when the contact assembly 204 is positioned within the housing 202.

A contact end 240 extends forward from the pivot portion 236 of each moveable contact 216. The contact ends 240 extend in an opposite direction from the actuating ends 238. Each contact end 240 includes a contact interface 242 that is configured to engage the wire. In particular, the wire is secured between the contact interface 242 of each moveable contact 240, when the contact assembly 204 is in the connection position 218 (shown in FIG. 8). Each contact interface 242 includes an engagement tab 244 that engages the wire in the connection position 218. In one embodiment, the wire is secured or pinched between the engagement tabs 244. Alternatively, the engagement tabs 244 may compress the wire.

Figure 7:
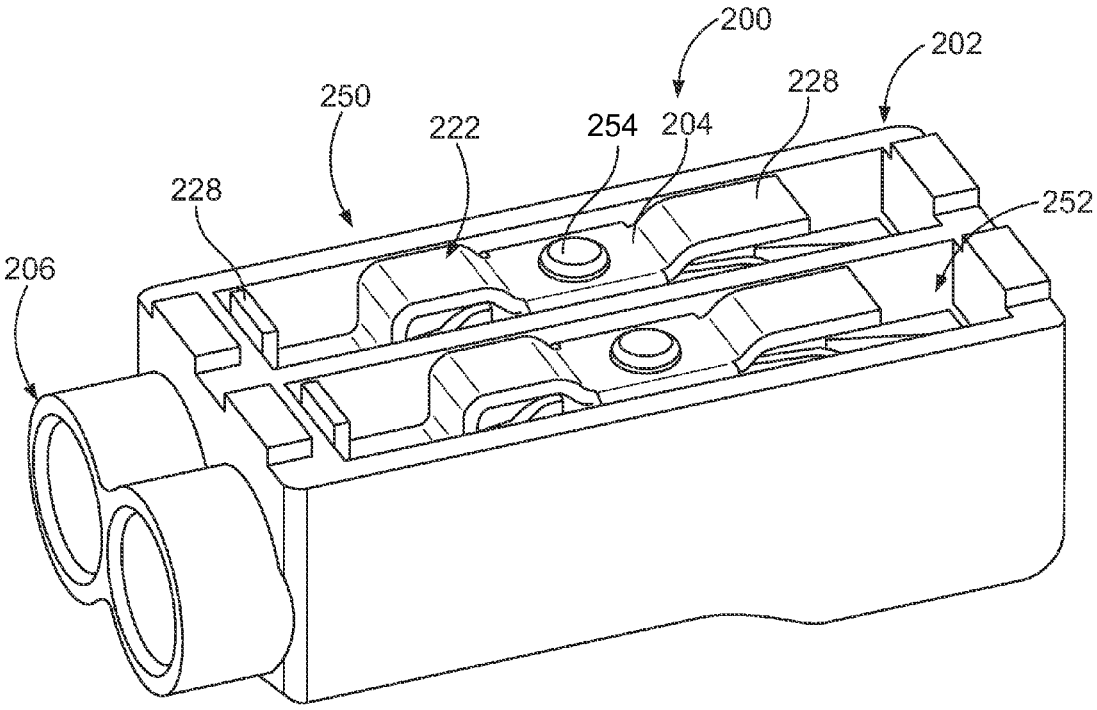
FIG. 7 is a bottom perspective view of the electrical connector shown in FIG. 5.

FIG. 7 is a bottom perspective view of the electrical connector 200. FIG. 7 illustrates a bottom 250 of the electrical connector 200. The bottom 250 includes openings 252 extending therealong. Each opening 252 is aligned with a receptacle 206 of the housing 202. A contact assembly 204 is positioned within each opening 252. The contact assembly 204 is secured to the housing 202 with a stake 254 that is received through the opening 226 (shown in FIG. 6) of the fixed contact 222. The contact assembly 204 is positioned within the housing 202 so that the contact assembly 204 is aligned with a receptacle 206. The surface-mount tails 228 of each fixed contact 222 are positioned substantially flush with the bottom 250 of the housing 202. When the housing 202 is positioned on the substrate 102, the surface-mount tails 228 are positioned in contact with a signal pad of the substrate 102. In another embodiment, the surface-mount tails 228 extend from the bottom 250 of the housing 202. In such an embodiment, the surface-mount tails 228 are through-hole mounted to the substrate 102.

Figure 8:
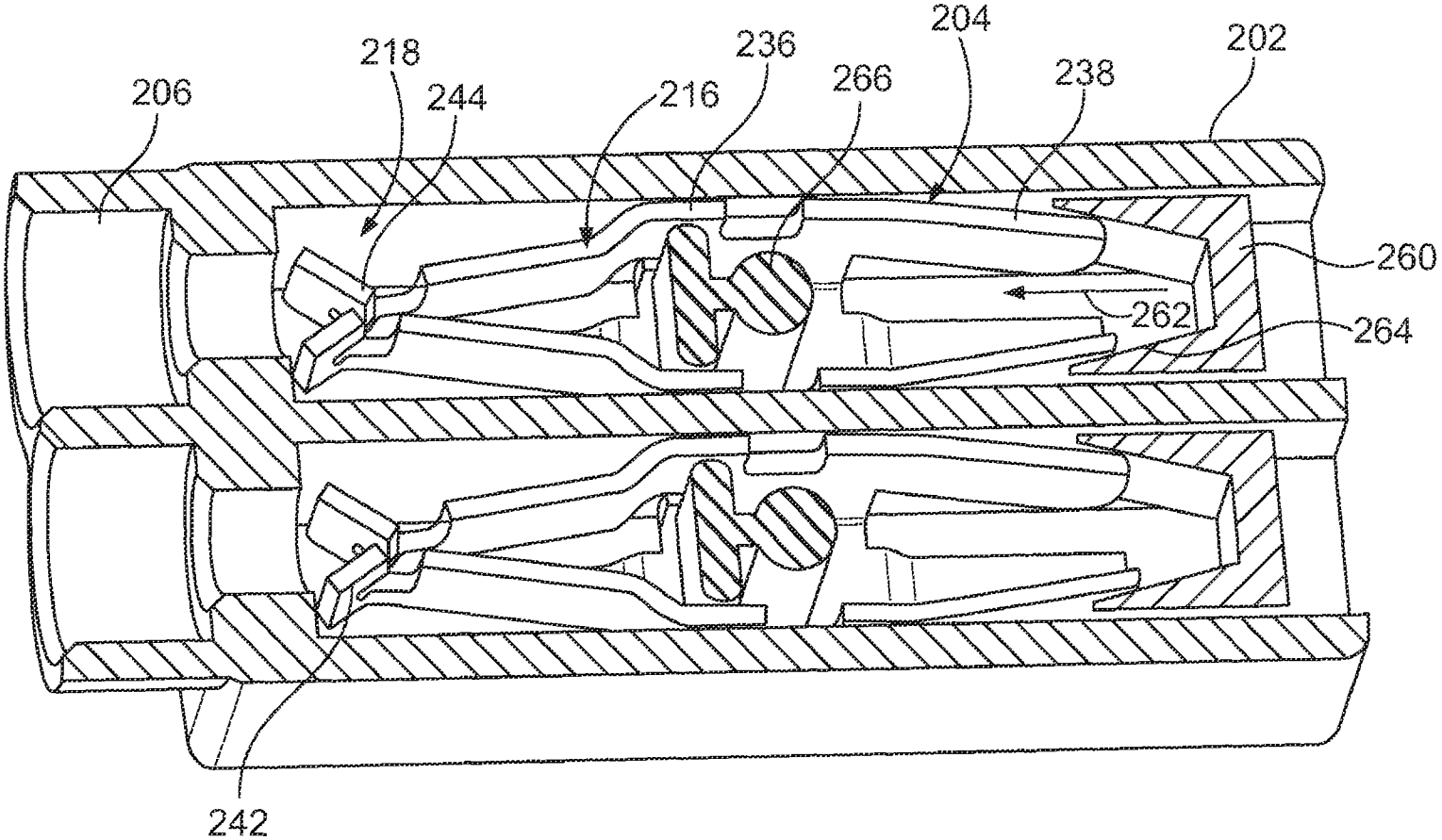
FIG. 8 is a top perspective cut-away view of the electrical connector shown in FIG. 5 and having the moveable contact in a connection position.

FIG. 8 is a top perspective cut-away view of the electrical connector shown 200. The contact assemblies 204 are positioned within the housing 202. FIG. 8 illustrates the moveable contacts 216 of each contact assembly 204 in the connection position 218. In the connection position 218, the contact interfaces 242 of the moveable contacts 216 engage one another. Accordingly, when a wire is inserted into a receptacle 206, the wire pushes the contact interfaces 242 apart and slides between the contact interfaces 242. The contact interfaces 242 are biased into the connection position 218 to secure the wire therebetween. The engagement tabs 244 of the moveable contacts 216 secure or pinch the wire therebetween.

Actuating wedges 260 are positioned at the back 214 of the housing 202. Each actuating wedge 260 is in contact with an actuator 210 shown in FIG. 5. Each actuating wedge 260 is also in contact with the actuating ends 238 of a moveable contact 216. The actuator 210 engages the moveable contact 216 through the actuating wedge 260. When a force is applied to the actuator 210, the actuator 210 moves the actuating wedge 260 in the direction of arrow 262. The actuating wedge 260 includes a pair of angled flanges 264 that engage the actuating ends 238 of the moveable contact 216. As the actuating wedge 260 moves in the direction of arrow 262, the angled flanges 264 move the actuating ends 238 of the moveable contact 216 toward one another.

The pivot portion 236 of the moveable contact 216 is in contact with a pivot point 266 formed in the housing 202. The moveable contact 216 is configured to rotate about the pivot point 266. As the actuating ends 238 of the moveable contact 216 are forced toward one another by the actuating wedge 260, the moveable contacts 216 rotate about the pivot point 266 to separate the contact interfaces 242 of the moveable contact 216. Accordingly, the moveable contact 216 is moved from the connection position 218 to the release position 220 (shown in FIG. 9) by applying a force to the actuator 210.

Figure 9:
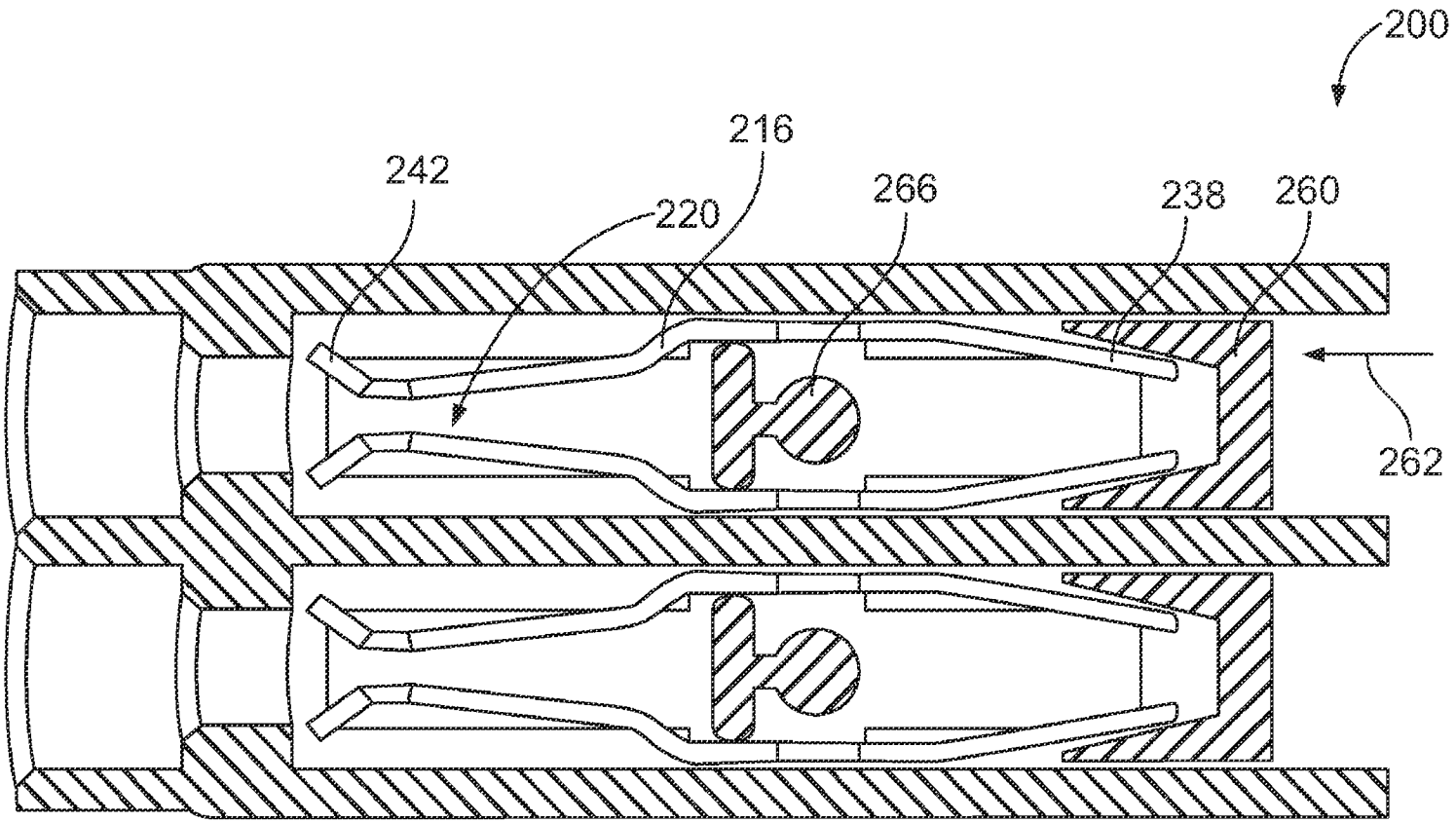
FIG. 9 is a top perspective cut-away view of the electrical connector shown in FIG. 5 and having the moveable contact in a release position.

FIG. 9 is a top perspective cut-away view of the electrical connector 200 having the moveable contact 216 in the release position 220. The actuating wedge 260 has been moved along the direction of arrow 262 to move the actuating ends 238 of the moveable contact 216 toward one another. The moveable contacts 216 have been rotated about the pivot point 266 to separate the contact interfaces 242 of the moveable contact 216. Accordingly, in the release position 220, the wire can be removed from between the contact interfaces 242.

Figure 10:
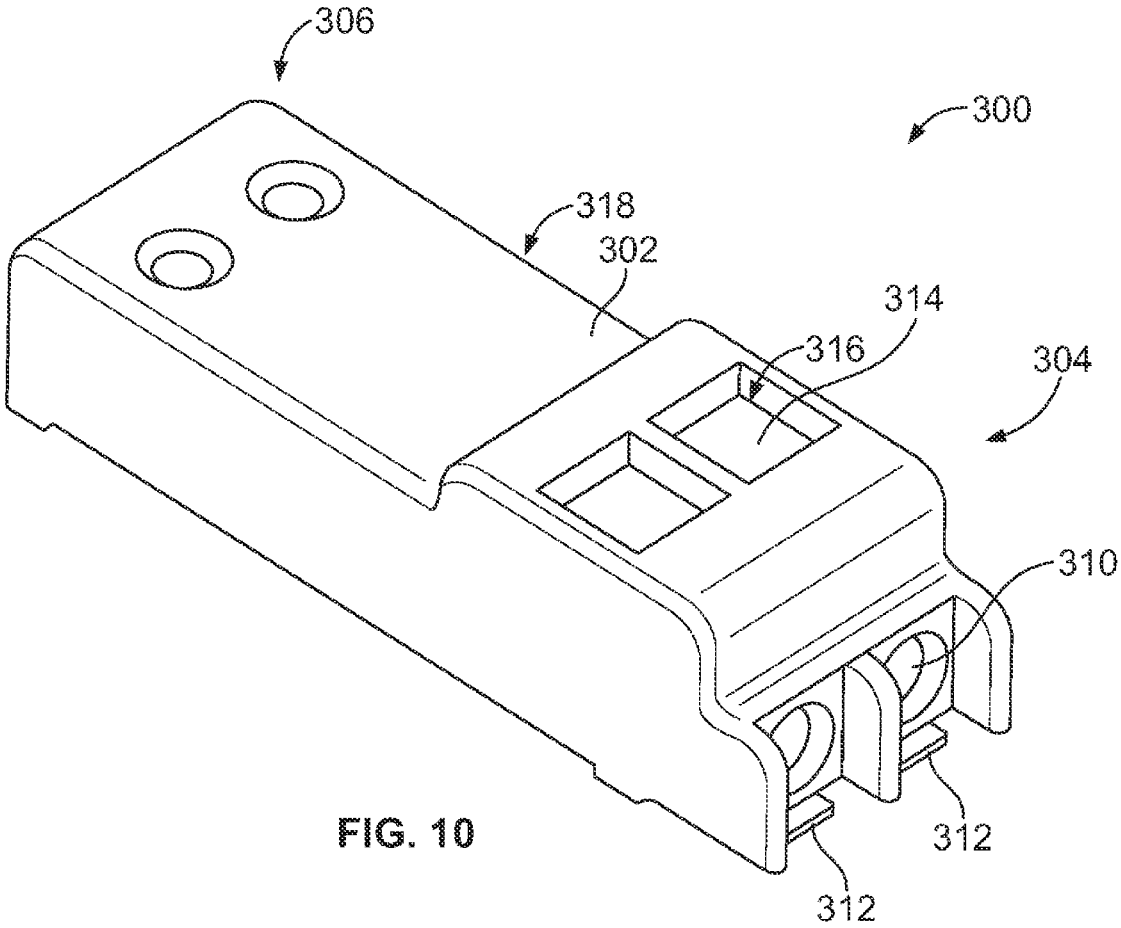
FIG. 10 is a top perspective view of an electrical connector formed in accordance with another embodiment.

FIG. 10 is a top perspective view of another electrical connector 300 formed in accordance with an embodiment. The electrical connector 300 includes a housing 302 having a front end 304 and a back end 306. The housing 302 is configured to retain contact assemblies 308 (shown in full in FIGS. 11 and 12). The front end 304 of the housing 302 includes receptacles 310 that are each aligned with a contact assembly 308. The illustrated embodiment includes two receptacles 310 to correspond to two contact assemblies 308. Optionally, the housing 302 may include any number of receptacles 310 and corresponding contact assemblies 308.

Each contact assembly 308 includes termination contacts 312 that are configured to be surface mounted to a substrate, for example, the substrate 102 shown in FIG. 1). Alternatively, the termination contacts 312 may be through-hole mounted to the substrate 102. Each contact assembly 308 also includes an actuator 314 that is accessible through an opening 316 in a top 318 of the housing 302. The actuator 314 is configured to receive a force 320 (shown in FIG. 11) to move a moveable contact 322 (shown in FIGS. 11 and 12) of the contact assembly 308 from a connection position 324 (shown in FIG. 12) to a release position 326 (shown in FIG. 11).

Figure 11:
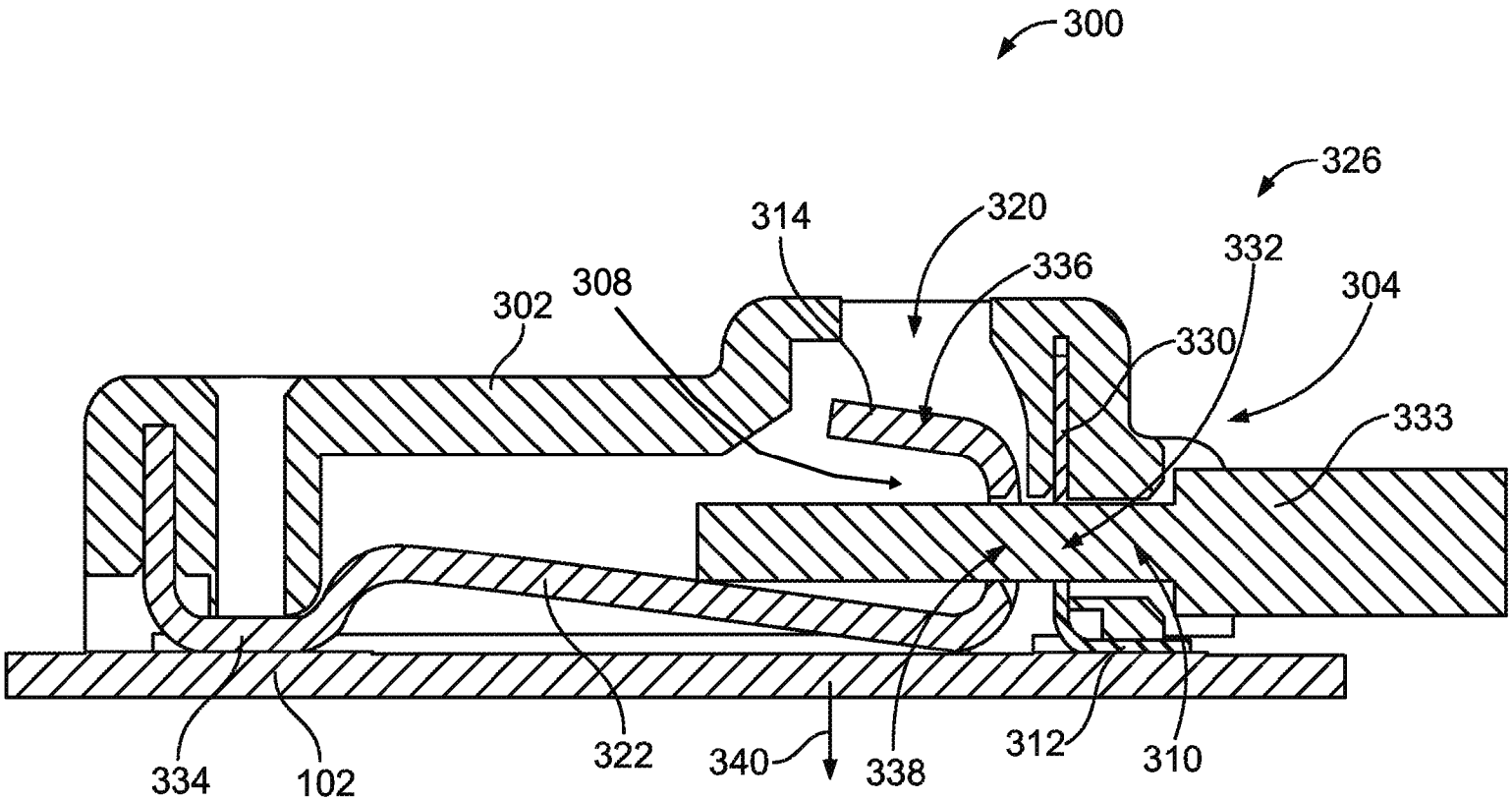
FIG. 11 is a side cross-sectional view of the electrical connector shown in FIG. 10 and having a moveable contact in a release position.

FIG. 11 is a side cross-sectional view of the electrical connector 300 having the moveable contact 322 in the release position 326. The contact assembly 308 includes the moveable contact 322 and a fixed contact 330. The fixed contact 330 is positioned in the front end 304 of the housing 302. The fixed contact 330 includes an opening 332 that is aligned with the receptacle 310. The opening 332 is configured to receive a wire 333 that is inserted into the receptacle 310. The termination contact 312 extends from the fixed contact 330.

The moveable contact 322 is formed as a spring contact. The moveable contact 322 includes a termination contact 334 that is mounted to the substrate 102. The moveable contact 322 includes a contact interface 336. The contact interface 336 includes an opening 338 to receive the wire 333. The contact interface 336 includes the actuator 314. In the illustrated embodiment, a force 320 is applied to the actuator 314 to move the contact interface 336 of the moveable contact 322 in the direction of arrow 340 into the release position 326. The opening 338 in the contact interface 336 is aligned with the opening 332 in the fixed contact 330 and the receptacle 310. Accordingly, the connector 300 is configured to receive the wire 333 and/or the wire 333 is enabled to be removed from the connector 300.

Figure 12:
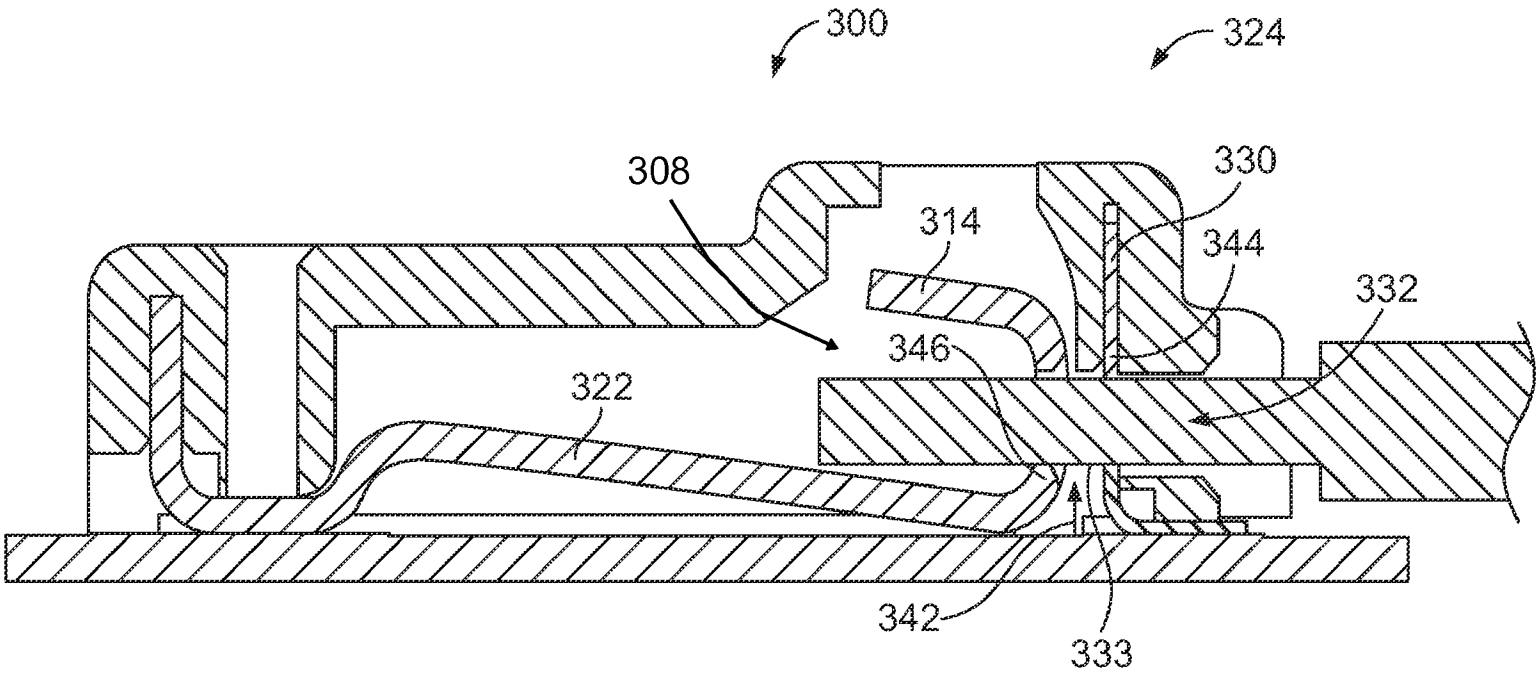
FIG. 12 is a side cross-sectional view of the electrical connector shown in FIG. 10 and having the moveable contact in a connection position.

FIG. 12 is a side cross-sectional view of the electrical connector 300 having the moveable contact 322 in a connection position 324. In the connection position 324, the wire 333 has been inserted into the connector 300. The force 320 (shown in FIG. 11) has been removed from the actuator 314. The moveable contact 322 is biased into the connection position 324, when the force 320 is removed. The contact interface 336 moves in the direction of arrow 342, when the force 320 is removed. The contact interface 336 creates a force on the wire 333 that pushes the wire 333 upward into contact with the fixed contact 330. A top surface 344 defined by the opening 332 in the fixed contact 330 engages the wire 333. Likewise, a bottom surface 346 defined by the opening 338 in the contact interface 336 engages the wire 333. In one embodiment, the top surface 344 and the bottom surface 346 may compress the wire 333. The wire 333 forms an electrical connection between with both the fixed contact 330 and the moveable contact 322 in the connection position 324. As such, the fixed contact 330 and the moveable contact 322 are electrically coupled by the wire 333.

To release the wire 333 from the connector 300, the force 320 is applied to the actuator 314 to move the moveable contact 322 back into the release position 326, wherein the wire 333 may be removed.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the invention without departing from their scope. While the dimensions and types of materials described herein are intended to define the parameters of the various embodiments of the invention, the embodiments are by no means limiting and are exemplary embodiments. Many other embodiments will be apparent to those of skill in the art upon reviewing the above description. The scope of the various embodiments of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose the various embodiments of the invention, including the best mode, and also to enable any person skilled in the art to practice the various embodiments of the invention, including making and using any devices or systems and performing any incorporated methods. The patentable scope of the various embodiments of the invention is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. An electrical connector comprising:

a housing having a receptacle for receiving a wire;

a fixed contact positioned within the housing and having a termination contact configured to electrically couple to a signal path; and a moveable contact configured to electrically couple to the fixed contact, the moveable contact having a contact interface for engaging the wire, the contact interface moveable between a connection position, wherein the contact interface engages the wire, and a release position, wherein the contact interface is disengaged from the wire to enable the wire to be removed from the receptacle, wherein the connector includes a spring that presses against the fixed contact such that the spring biases the contact interface of the moveable contact to the connection position.

2. The connector of claim 1 further comprising an actuator that engages the moveable contact to move the contact interface of the moveable contact between the connection position and the release position.

3. The connector of claim 1, wherein the moveable contact is a spring contact.

4. The connector of claim 1, wherein the fixed contact includes an opening that receives the wire therethrough, the opening sized to receive different gauge wires.

5. The connector of claim 1, wherein the fixed contact includes an opening that receives the wire therethrough, the opening aligned with the receptacle of the housing.

6. The connector of claim 1, wherein the termination contact of the fixed contact at least one of surface mounts or through-hole mounts to a substrate having the signal path extending therethrough to create an electrical connection with the signal path.

7. The connector of claim 1, wherein the contact interface compresses the wire in the connection position.

8. The connector of claim 1, wherein the moveable contact comprises the spring.

9. The connector of claim 1, wherein the spring is integrally formed with the moveable contact such that the spring and the moveable contact define a single, unitary body.

10. The connector of claim 1, wherein the moveable contact engages the fixed contact to electrically couple the moveable contact to the fixed contact.

11. The connector of claim 1 further comprising an actuator configured to move the contact interface of the moveable contact between the connection position and the release position, the actuator being integrally formed with the moveable contact such that the actuator and the moveable contact define a single, unitary body.

12. A substrate assembly comprising:

a substrate having a signal path extending therethrough;

a connector positioned on the substrate, the connector including a housing having a receptacle for receiving a wire;

a fixed contact positioned within the housing and having a termination contact at least one of surface mounted or through-hole mounted to the substrate to create an electrical connection with the signal path; and a moveable contact configured to electrically couple to the fixed contact, the moveable contact having a contact interface for engaging the wire, the contact interface moveable between a connection position, wherein the contact interface engages the wire, and a release position, wherein the contact interface is disengaged from the wire to enable the wire to be removed from the receptacle, wherein the moveable contact includes an actuator that is configured to move the contact interface of the moveable contact between the connection position and the release position, and wherein the actuator is integrally formed with the moveable contact such that the actuator and the moveable contact define a single, unitary body.

13. The substrate assembly of claim 12, wherein the moveable contact is a spring loaded contact.

14. The substrate assembly of claim 12, wherein the moveable contact is a spring contact.

15. The substrate assembly of claim 12, wherein the moveable contact is biased into the connection position.

16. The substrate assembly of claim 12, wherein the fixed contact includes an opening that receives the wire therethrough, the opening sized to receive different gauge wires.

17. The substrate assembly of claim 12, wherein the fixed contact includes an opening that receives the wire therethrough, the opening aligned with the receptacle of the housing.

18. The substrate assembly of claim 12, wherein the moveable contact engages the fixed contact to electrically couple the moveable contact to the fixed contact.

19. The substrate assembly of claim 12, wherein the connector includes a spring that presses against the fixed contact such that the spring biases the contact interface of the moveable contact to the connection position.

* * * * *

UNITED STATES PATENT AND TRADEMARK OFFICE

CERTIFICATE OF CORRECTION

PATENT NO. : 8,550,838 B2
APPLICATION NO. : 13/190025
DATED : October 8, 2013
INVENTOR(S) : Osenaga Jerry Osagie et al.

It is certified that error appears in the above-identified patent and that said Letters Patent is hereby corrected as shown below:

On the title page item (75), the identified Inventor name was incorrectly spelled, OSENAGA JERRY OSAGLE should be corrected to show the inventors correct name OSENAGA JERRY OSAGIE.

Signed and Sealed this
Nineteenth Day of November, 2013

Teresa Stanek Rea

Teresa Stanek Rea
*Deputy Director of the United States Patent and Trademark Office*